US008201600B2

(12) United States Patent
Birkett et al.

(10) Patent No.: US 8,201,600 B2
(45) Date of Patent: Jun. 19, 2012

(54) DIMENSIONALLY STABLE WOOD AND METHOD FOR MAKING DIMENSIONALLY STABLE WOOD

(75) Inventors: Terri Williams Birkett, Stuart, VA (US); Buddy Earl Williams, Stuart, VA (US); Warren Lee Williams, Stuart, VA (US)

(73) Assignee: Ten Oaks LLC, Stuart, VA (US)

( * ) Notice: Subject to any disclaimer, the term of this patent is extended or adjusted under 35 U.S.C. 154(b) by 622 days.

(21) Appl. No.: 11/702,455

(22) Filed: Feb. 5, 2007

(65) Prior Publication Data

US 2007/0130881 A1 Jun. 14, 2007

Related U.S. Application Data

(63) Continuation-in-part of application No. 11/203,492, filed on Aug. 12, 2005, now abandoned, and a continuation-in-part of application No. 11/147,738, filed on Jun. 8, 2005, now abandoned.

(51) Int. Cl.
*B27F 1/00* (2006.01)

(52) U.S. Cl. ..... 144/347; 144/344

(58) Field of Classification Search ..... 144/347, 144/173, 368, 344, 348, 350, 360, 380, 156, 144/427, 428; 52/589.1, 515; 427/385.5, 427/393, 397, 508, 256, 258, 260, 291, 297, 427/317, 355, 408, 428.1; 428/540, 541
See application file for complete search history.

(56) References Cited

U.S. PATENT DOCUMENTS

| | | | | |
|---|---|---|---|---|
| 2,136,351 | A | 11/1938 | Gray | |
| 4,258,651 | A * | 3/1981 | Knudtson et al. | 118/114 |
| 4,320,898 | A * | 3/1982 | Brunst et al. | 473/117 |
| 5,113,632 | A * | 5/1992 | Hanson | 52/385 |
| 5,299,400 | A | 4/1994 | Sing | |
| 5,352,317 | A * | 10/1994 | Traben et al. | 156/254 |
| 5,502,939 | A * | 4/1996 | Zadok et al. | 52/309.9 |
| 5,827,592 | A * | 10/1998 | Van Gulik et al. | 428/44 |
| 5,881,786 | A | 3/1999 | Wilderman et al. | |
| 5,894,700 | A * | 4/1999 | Sweet | 52/391 |
| 6,029,416 | A * | 2/2000 | Andersson | 52/592.1 |
| 6,148,884 | A * | 11/2000 | Bolyard et al. | 144/369 |
| 6,336,484 | B1 | 1/2002 | Grenier et al. | |
| 6,766,622 | B1 * | 7/2004 | Thiers | 52/591.3 |
| 6,922,965 | B2 * | 8/2005 | Rosenthal et al. | 52/592.1 |
| 7,332,053 | B2 * | 2/2008 | Palsson et al. | 156/305 |
| 2003/0024199 | A1 * | 2/2003 | Pervan et al. | 52/589.1 |
| 2004/0159066 | A1 * | 8/2004 | Thiers et al. | 52/578 |
| 2004/0182036 | A1 * | 9/2004 | Sjoberg et al. | 52/592.1 |
| 2004/0226243 | A1 * | 11/2004 | Lin et al. | 52/384 |

OTHER PUBLICATIONS www.woodweb.com, Hardwood Flooring and Millwork—Finishing Options, 1999.*

International Search Report and Written Opinion issued for International Patent Application No. PCT/US2006/031391, May 1, 2007.

* cited by examiner

*Primary Examiner* — Gregory Huson

*Assistant Examiner* — Jennifer C Chiang

(74) *Attorney, Agent, or Firm* — Wilmer Cutler Pickering Hale and Dorr LLP

(57) ABSTRACT

A wood plank which is dimensionally stable and moisture resistant includes a sealant layer on at least four of its sides. A geometric variation (e.g., tongue and groove) may be located on at least one side of the dimensionally stable wood. The sealant layer may be applied to the tongue and groove as well. A method for manufacturing the dimensionally stable wood is also described.

33 Claims, 9 Drawing Sheets

DIMENSIONALLY STABLE WOOD AND METHOD FOR MAKING DIMENSIONALLY STABLE WOOD

CROSS-REFERENCE TO RELATED APPLICATIONS

This application is a continuation-in-part of U.S. application Ser. No. 11/203,492, filed Aug. 12, 2005, and U.S. application Ser. No. 11/147,738, filed Jun. 8, 2005, both of which are incorporated herein by reference in their entireties.

FIELD OF THE INVENTION

The present invention relates to dimensionally stable wood and a method for making dimensionally stable wood for job site finishing.

BACKGROUND OF THE INVENTION

Using solid hardwood as flooring is a very old practice. Early wood floors ranged from halves of logs or boards placed over a dirt floor to sawn wood planks fastened across floor joists. The boards were unsanded and unfinished. As technology progressed, the process for making floorboards included making the boards smoother by hand planing the boards. An oil, wax, or resin was sometimes rubbed into finer floors to put a seal or finish on the top surface of the floor. In order to fit the boards more tightly together and to add strength to the span between the floor joists, geometric variations (e.g., a tongue and groove) were added (e.g., molded) to the edges of the boards. The development of kiln-drying technology enabled significant improvement in dimensional stability of the wood that was affected by seasonal moisture changes. Most of the later additions to the process of manufacturing solid wood flooring increased its usability, strength, appearance, serviceability, and/or dimensional stability.

Presently, manufacturing jobsite finished solid wood flooring includes some or most of the following steps: sawing logs into boards, air drying and kiln-drying the boards, planing the rough sawn boards, ripping the boards into more narrow strips, sawing out defects, molding the strips to have a tongue on one long side and a groove on the other long side, molding the ends of the strip to have a tongue on one end and groove on the other end, installing the strips in a building, sanding the strips after they are installed, and spreading several finish coats on the entire surface of the floor.

Numerous problems with the prior process for manufacturing solid wood flooring exist, such as inaccuracies in molded solid wood flooring resulting in gaps between the joints. Also, moisture is absorbed into the wood leading to dimensional instability. Others have tried to produce dimensionally stable wood. For example, processes have included laminating layers of wood together. This technology increases some dimensional stability, however, these laminated layers of wood (e.g., engineered and floating floors) lack the appeal of solid wood floors in sound, feel, and appearance. Others have produced factory finished products. Factory finished products, however, lack the desirable match and appearance of a jobsite finished floor.

The present invention addresses and applies a novel technology to the aforementioned problems.

SUMMARY OF THE INVENTION

In accordance with the present invention, a dimensionally stable wood plank and methods for production are provided.

In some embodiments, a dimensionally stable wood plank includes a wood plank with at least six sides. A sealant layer is located on each of at least four sides. In some instances, geometric variations (e.g., tongues and grooves) are formed (e.g., molded) and a sealant layer is applied to the geometric variations.

In some embodiments, a dimensionally stable wood plank is produced by adding a geometric variation to a wood plank, applying a sealant layer to the wood plank, and curing the sealant layer. In some instances, the sealant layer is applied using vacuum coating. In other instances, the sealant layer is at least one of brushed on, sprayed on, misted on, and dip coated on to the wood plank.

BRIEF DESCRIPTION OF THE DRAWINGS

Various objects, features, and advantages of the present invention can be more fully appreciated with reference to the following detailed description of the invention when considered in connection with the following drawings, in which like reference numerals identify like elements.

DETAILED DESCRIPTION OF THE INVENTION

The following description includes many specific details. The inclusion of such details is for the purpose of illustration only and should not be understood to limit the invention.

Moreover, certain features, which are well known in the art, are not described in detail in order to avoid complication of the subject matter of the present invention. In addition, it will be understood that features in one embodiment may be combined with features in other embodiments of the invention.

Figure 1:
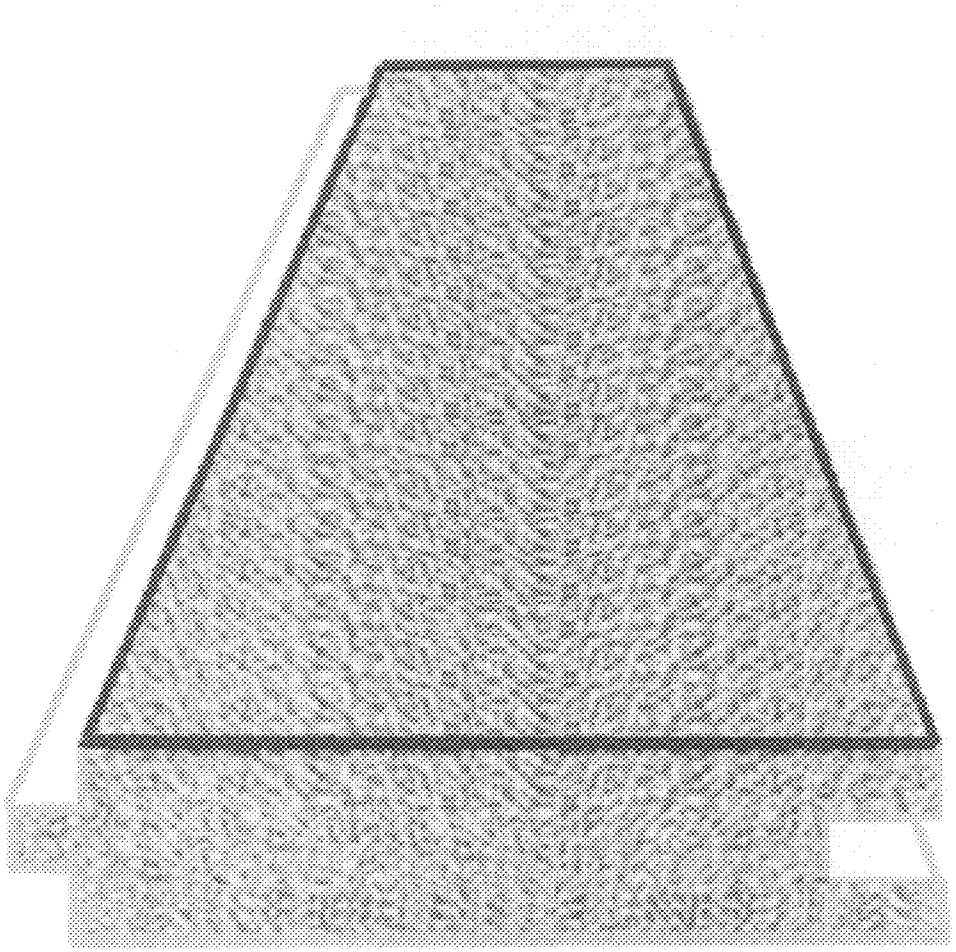
FIG. 1 illustratively displays a standard wood plank used in job site finished flooring in accordance with some embodiments of the disclosed subject matter.

Referring to FIG. 1, an illustrative standard wood plank is displayed. As shown, a standard wood plank includes at least six sides (i.e., top side, bottom side, two edges, and two ends). Geometric variations may be formed (i.e., molded) on the two edges and two ends. For example, geometric variations molded on the two edges and two ends of a standard wood planks or dimensionally stable wood planks may be used as flooring joints. Geometric variations may be, for example, a woodworking joint (e.g., tongue and groove, a butt, butterfly, dowel, dovetail, finger or box combing, lap (halving joint), cross-lap, halved joint, dovetail-lap, end-lap (corner halving joint), middle-lap (Tee halving joint), miter (mitre), mortise and tenon, rabbet (rebate), scarf (scarph), and splice joint, etc.) or any other geometric variation deemed suitable by one practiced in the field. It will be understood that, similar to a standard wood plank, a dimensionally stable wood plank may be used at a jobsite (e.g., building construction, building remodeling, etc.) for use in a building (e.g., flooring, interior wood paneling, exterior paneling, etc.).

Figure 2:
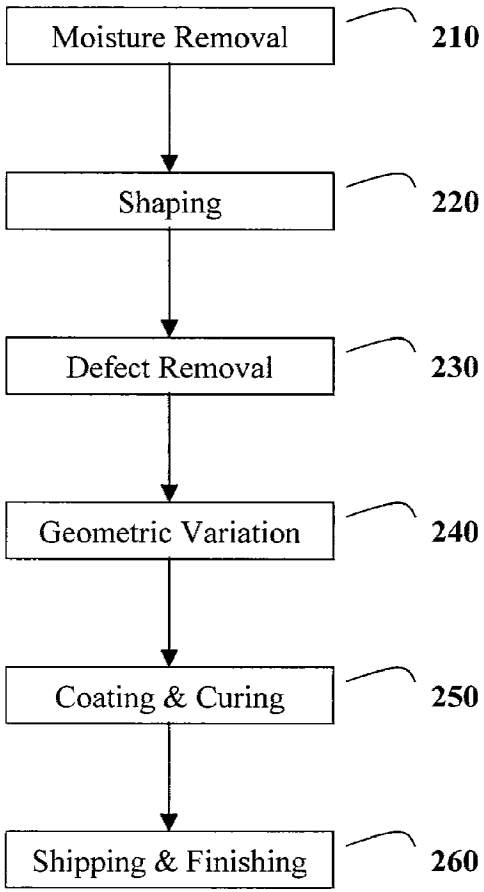
FIG. 2 illustratively displays a flow chart outlining the general method for producing dimensionally stable wood in accordance with some embodiments of the disclosed subject matter.

Referring to FIG. 2, an illustrative diagram displays steps for producing a dimensionally stable wood plank. Initially, moisture is removed from wood lumber at moisture removal step 210. For example, green, rough sawn lumber may be air dried to a moisture content of less than 30%. Air dried lumber may then be kiln dried to a moisture content of about 6 to 8%. When a desired moisture content is reached the lumber may be shaped at shaping step 220. At shaping step 220, for example, the lumber may be planed to an equal thickness and then ripped longitudinally into narrow strips. Alternatively, for example, at shaping step 220, the lumber may be ripped into narrow strips without planing. Upon completing shaping step 220, wood defects may be removed from the wood at defect removal step 230. At defect removal step 230, for example, the narrow strips may have defects removed by using cutoff saws, which saw out defects using a transverse cut or an additional process of splitting the boards horizontally in thickness before or after defect removal may be used. After defect removal step 230, geometric variations (e.g., tongue and groove) may be formed (e.g., molded) on the edge and ends of the wood at geometric variation step 240.

At geometric variation step 240, in some embodiments, the strips may be molded on a molder or flooring machine/sidematcher. In other instances, the strips may be planed and then the strips may be molded. This process may, for example, mold a tongue and groove in the long sides (i.e., two edges) of the strip, plane the surfaces (i.e., top side and bottom side) of the strip, and mold the short sides (i.e., two ends) of the strip. At geometric variation step 240, in some embodiments, the geometric variation (e.g., the tongue and groove) is accurately referenced from one side (e.g., the face) of the strips. In some embodiments, geometric variations may only be formed on one of the two ends or the two edges. It will be understood that a side with geometric variations may be referred to as a side.

At coating and curing step 250, in some embodiments, wood (i.e., wood strips) with geometric variations are coated with a sealant layer and cured. At coating and curing step 250, in some embodiments, the two ends and two edges of the wood strips must be coated with a sealer and cured. It will be apparent that, in some embodiments, only one of the two ends or the two edges of the wood strips must be coated with a sealer and cured. For example, the two edges may include geometric variations that are coated with a sealant layer and cured while the two ends are not coated an cured. The remaining sides may then be coated with a sealer and cured. Curing may comprise, for example, air curing, kiln curing, chemically curing, and any other method of curing deemed suitable. In some embodiments, the two ends and two edges may be coated after the top side and bottom side are coated. In some embodiments only one of the two ends or the two edges may be coated after the top side and bottom side are coated.

In some embodiments, a sealant layer may be applied using vacuum coating. Vacuum coating may be used, for example, to apply sealer to contoured areas of the wood. In some embodiments, a sealant layer may be applied using a brush. In other embodiments, a sealant layer may be sprayed or misted onto wood with geometric variations. This may be done, for example, to provide a thinner sealant layer on wood with geometric variations. Further, in some embodiments, a sealant layer may be applied using rollers that roll on a sealant layer. In some embodiments, rollers may be customized to apply an even coat onto the geometric variations. For example, a tongue shaped roller can be used to apply a sealant layer to a groove. In some embodiments, wood with geometric variations may be dip coated in sealant. This may be done to provide a fast method of applying a sealant layer on wood with geometric variations. In some embodiments, more than one technique for applying a sealant layer onto wood with geometric variations is used. For example, a sealant layer may be applied to the two edges and two ends using rollers while the top surface and bottom surface may have a sealant layer applied using a brush. It will be apparent that many methods for applying a sealant layer onto wood with geometric variations may be appropriate.

In some embodiments, a single sealant layer may be applied onto wood with geometric variations. That is, after applying a single sealant layer onto wood with geometric variations, the sealant may cure and proceed to shipping and finishing. In other embodiments, at least two sealant layers may be applied onto wood with geometric variations. For example, after a first sealant layer is applied and cures on wood with geometric variations at least one more sealant layer is applied on the wood with geometric variations. It will be apparent that this technique may be repeated as desired.

In some embodiments, a sealant layer is applied when the moisture content in the wood is substantially below ambient moisture (i.e., the moisture content naturally found in wood). For example, a sealant layer may be applied when the wood comprises a moisture content of 6 to 8% to maintain the moisture content at substantially below ambient moisture, thereby keeping the wood dimensionally stable.

During shipping and finishing step 260, the dimensionally stable wood (e.g., flooring, paneling, etc.) is stored and/or transported for installation at a job site. In some embodiments the dimensionally stable wood is job site finished. For example, at a flooring job site the solid flooring pieces are fastened to the sub floor. The walking surface (e.g., the top side) of the flooring is sanded to at least partially remove the sealant layer on the walking surface. After removing at least some of the top side sealant layer, the final finish coats are applied.

In some embodiments, the dimensionally stable wood is finished and then shipped. For example, unlike job site finishing, the dimensionally stable wood may be sanded and finish may be applied prior to shipping. In some embodiments, dimensionally stable wood is sanded to at least partially remove the sealant layer on the walking surface. After removing at least some of the top side sealant layer the final finish coats are applied and the dimensionally stable wood can be shipped. In other embodiments, the dimensionally stable wood does not require sanding to at least partially remove the sealant layer on the walking surface because the top side sealant layer acts as a final finish coat.

In some embodiments, as will be shown below, the combination of geometric variation step 240 and coating and curing step 250 provide the precision needed for substantially improved mating as well as increased dimensional stability and moisture resistance through the life of the flooring and paneling. Also, it will be apparent that at least some of the aforementioned steps may be combined, removed, or further separated.

In some embodiments, a dimensionally stable wood plank is produced without forming geometric variations. For example, most of the aforementioned steps may be used to produce a dimensionally stable wood plank, however, at least geometric variation step 240 can be removed from the process. It will be apparent that removing geometric variation step 240, a dimensionally stable wood plank may be produced without geometric variations.

Figure 3:
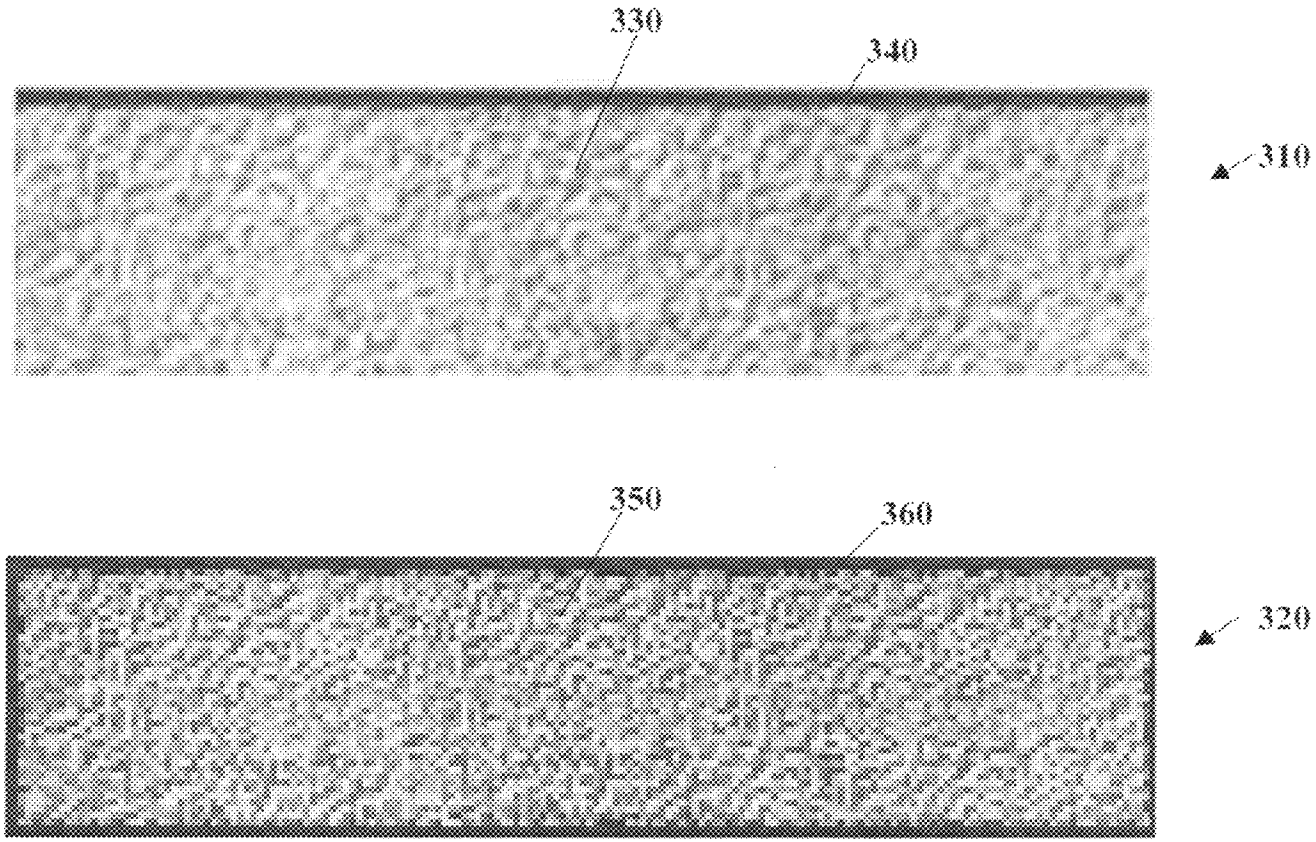
FIG. 3 illustratively displays a cross-sectional view of a standard wood plank and a dimensionally stable wood plank in accordance with some embodiments of the disclosed subject matter.

Referring to FIG. 3, in some embodiments, a dimensionally stable wood plank includes a sealant layer on all exposed surfaces. Cross-sectional views of a standard wood plank 310 and a dimensionally stable wood plank 320 are displayed. Standard wood plank 310 includes wood 330 and top sealant layer 340. Sealant layer 340 seals standard wood plank 310 on one side. Dimensionally stable wood plank 320 includes wood 350 and surrounding sealant layer 360. As shown, sealant layer 360 covers all sides of wood 350 creating a barrier to liquids, gases, and objects. It will be understood that sealant layer 360 may at least partially prevent liquids (e.g., water, wine, soda, salt water, mercury, etc.) or other objects (e.g., air, moisture in the air, termites, chemicals, etc.) from penetrating into the protected dimensionally stable wood. Further, sealant layer 360 may at least partially prevent damage (e.g., nicks, scratches, cut marks, etc.) to the protected dimensionally stable wood. For the sake of ease of description, this application will primarily describe moisture penetration.

Figure 4:
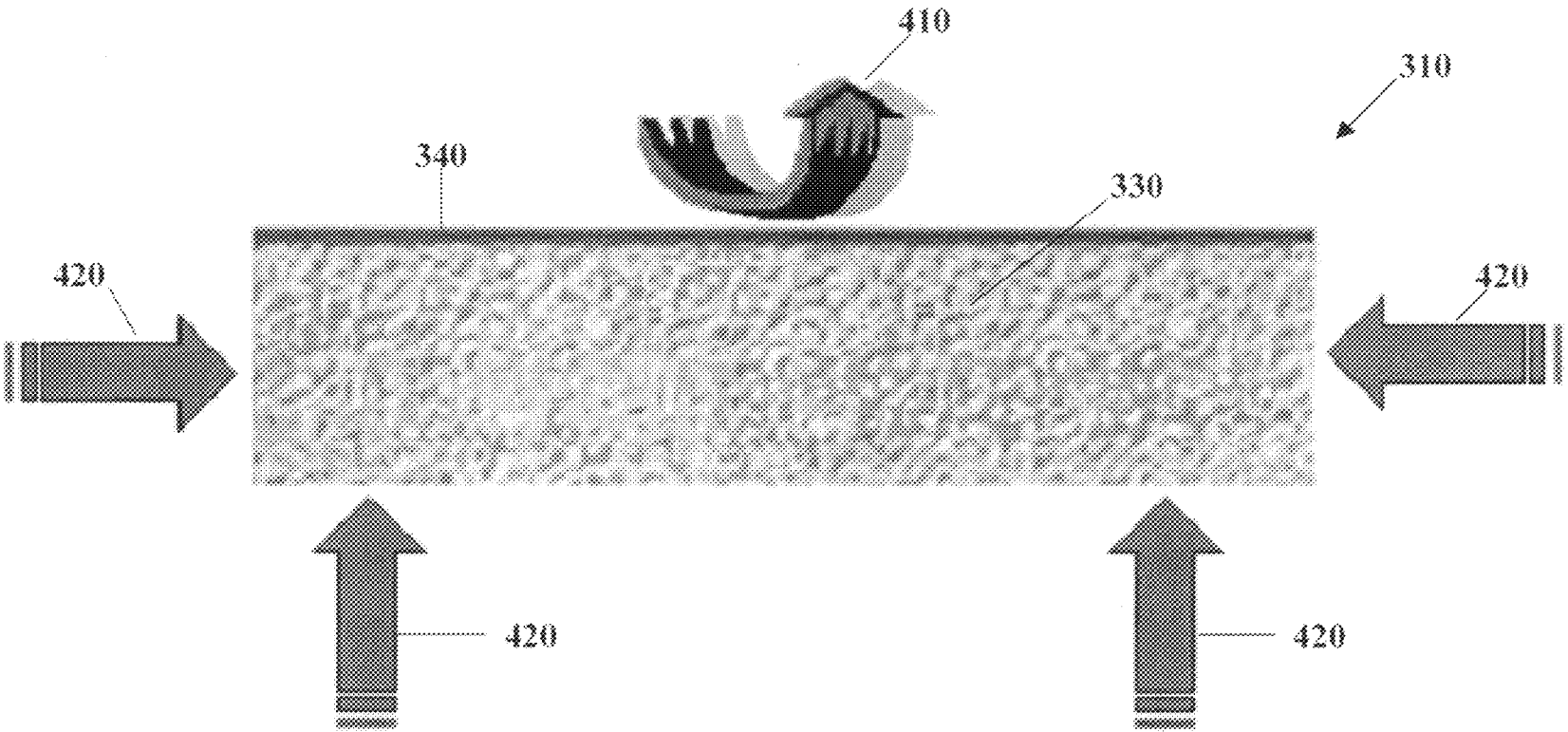
FIG. 4 illustratively displays a cross-sectional view of a standard wood plank with arrows indicating moisture penetration in accordance with some embodiments of the disclosed subject matter.

Referring to FIG. 4, an illustrative drawing demonstrates moisture penetrating standard wood 310. Standard wood 310 protects one surface from moisture. Arrow 410 refers to moisture prevented from entering wood 330 by sealant layer 340. Moisture arrows 420 refer to moisture penetrating into wood 330. As shown, moisture may enter wood 310 on all sides not protected by sealant layer 340.

Figure 5:
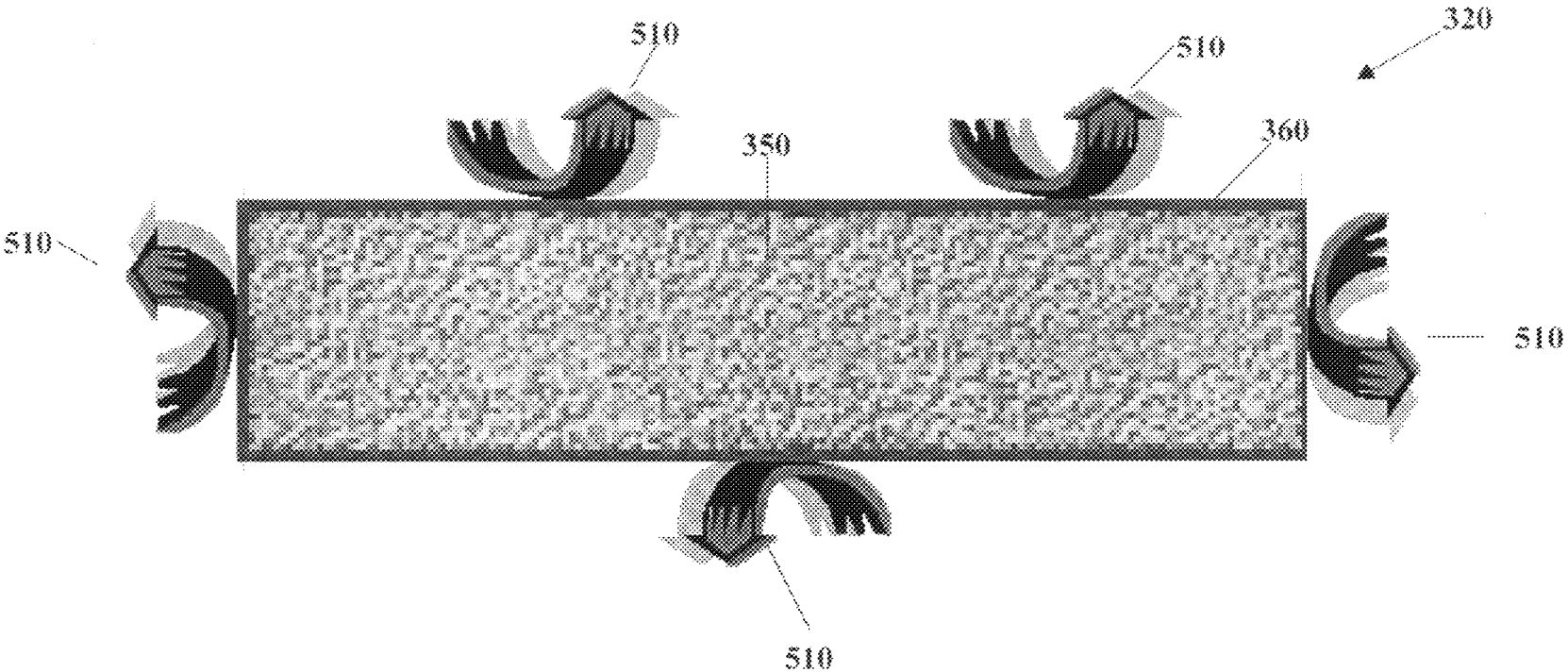
FIG. 5 illustratively displays a cross-sectional view of a dimensionally stable wood plank with arrows indicating moisture at least partially prevented from penetrating in accordance with some embodiments of the disclosed subject matter.

Referring to FIG. 5, in some embodiments, sealant layer 360 at least partially prevents moisture from penetrating wood 330. Arrows 510 refer to moisture at least partially prevented from penetrating into wood 350 by sealant layer 360. As shown, moisture is prevented from entering into wood 350 on all sides of dimensionally stable wood 320.

In some embodiments, sealant layer 360 may have substantially similar thickness on all sides of wood 350. For example, sealant layer 360 may be an even layer as thin as a few microns or as thick as 0.25 inches. Typically, sealant layer 360 is about 0.25 to 6 millimeters thick. In other embodiments, sealant layer 360 exhibits varied thickness on wood 350. For example, the top layer may have a thinner sealant layer than the edge layers. This may be done to decrease the amount of time required for job sight finishing of flooring. It will be understood that sealant layer 360 may only be as thick as is needed to at least partially prevent moisture from penetrating into wood 350.

In some embodiments, the sealant layer includes urethane. Any suitable urethane may be used as a sealant layer, such as, for example, UV-cured urethane, polyurethane, oil-modified urethane, moisture-cure urethane, acid cure urethane, water based urethane, acrylic-urethane, and solvent cured urethane. In other embodiments, the sealant layer may include other materials, such as, for example, aluminum oxide finishes, stain and wax, and ceramic sealer. It will be understood that the sealant layer may include any material deemed suitable by one practiced in the field.

In some embodiments, the sealant layer may exhibit a substantially similar chemical composition on all sides of the dimensionally stable wood. For example, all sides of the dimensionally stable wood may include a UV-cured urethane sealant layer. In other instances, the chemical composition of the sealer may be substantially different on at least one side of the dimensionally stable wood. For example, the top surface of a dimensionally stable wood may include acrylic-urethane while the remaining sides may include polyurethane. This may be done, for example, to ease job sight finishing of flooring.

In some embodiments, a dimensionally stable wood plank may include a single natural wood or a combination of at least two woods. For example, a dimensionally stable wood plank may include Ash White, Beech, Birch, Cherry, Douglas Fir, Hickory-Pecan, Maple Sugar, Mesquite, Red Oak, White Oak, Pine, Walnut, Bamboo, Brazilian Cherry, Bubinga, Cork, Curmaru, Cypress, Gum, Iroko, Jarrah, Mahogany, Maple, Merbau, Paduak, Purple Heart, Sapele, Teak, Walnut, Wenge, or any other species of wood deemed suitable. In other instances, a dimensionally stable wood plank may include at least one synthetic material. It will be understood that any wood (a single wood, a combination of different species of wood, a synthetic material, etc.) deemed suitable can be used as a dimensionally stable wood.

Figure 6:
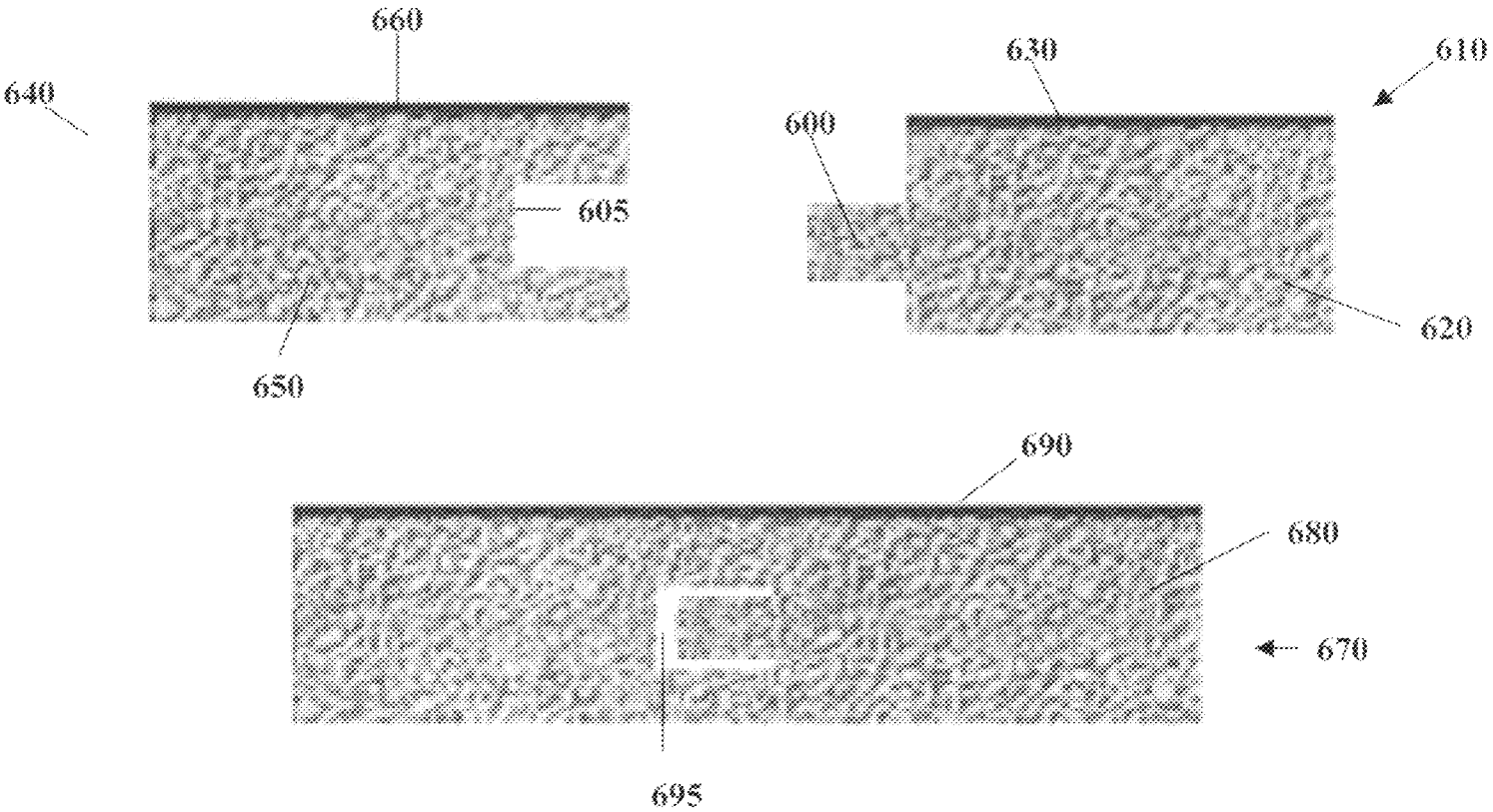
FIG. 6 illustratively displays a cross-sectional view of two standard wood planks with geometric variations separated and joined together in accordance with some embodiments of the disclosed subject matter.

Referring to FIG. 6, multiple standard woods with geometric variations on at least one side may join together. For example, multiple standard woods with geometric variations may be used in flooring and paneling. Standard wood 610 including wood 620, sealant layer 630, and geometric variation 600 (e.g., tongue) may combine with second standard wood 640 including wood 650, sealant layer 660, and geometric combination 605 (e.g., groove). Combining first standard wood 610 and second standard wood 640 creates combination wood 670 including wood 680 (i.e., wood 620 and wood 650) and sealant layer 690 (i.e., sealant layer 630 and sealant layer 660). As shown, combination wood 670 exhibits gap 695 where geometric variation 600 and geometric variation 605 mate. Gap 695 may lead to numerous deleterious effects over time. For example, gap 695 may cause combination wood 650 to pull apart over time weakening the stability of the wood.

Figure 7:
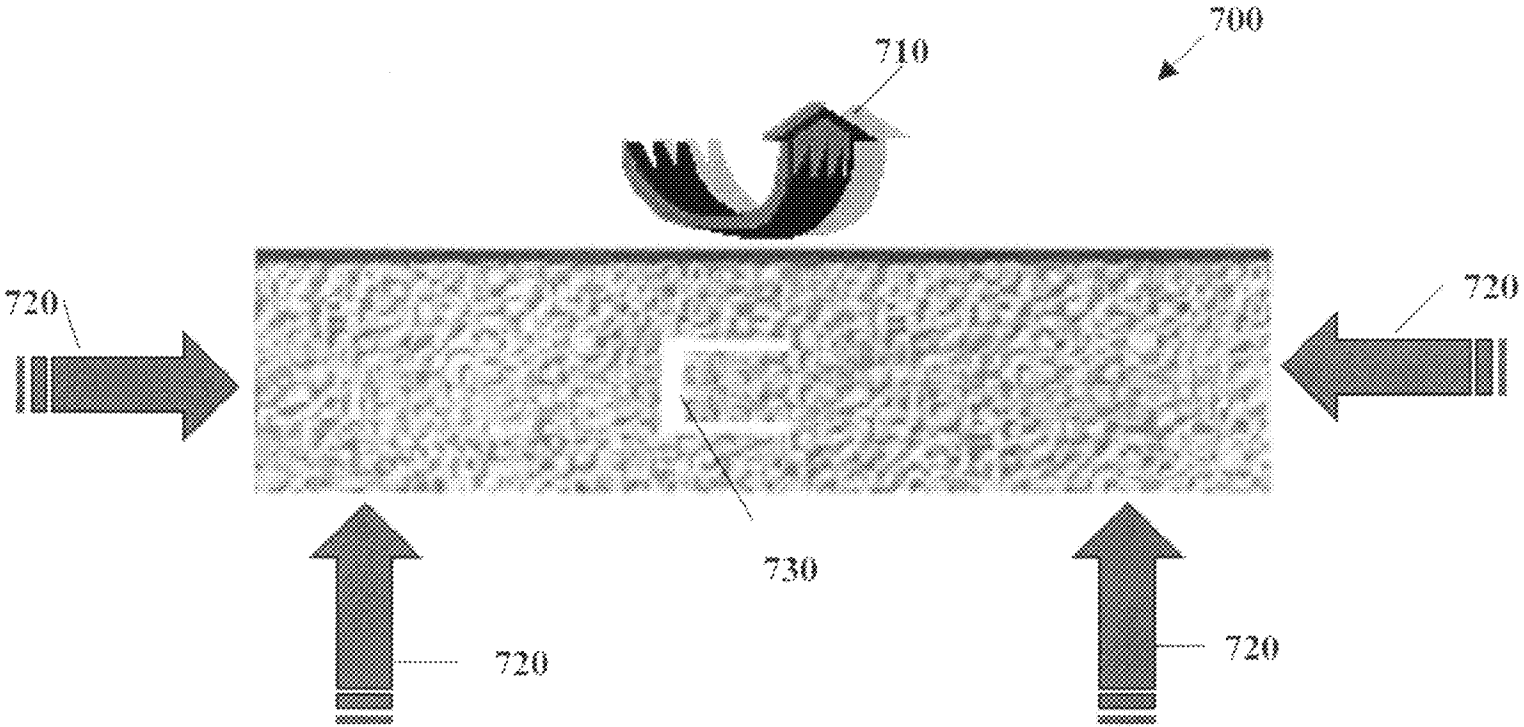
FIG. 7 illustratively displays a cross-sectional view of two standard wood planks joined together demonstrating a gap created by geometric variations and moisture penetration in accordance with some embodiments of the disclosed subject matter.

Referring to FIG. 7, an illustrative drawing displays moisture penetration and a gap created by combining standard wood, as illustrated in FIG. 6. As shown, arrow 710 refers to moisture at least partially prevented from penetrating standard wood 700 on one surface. However, moisture arrows 720 refer to moisture that may penetrate standard wood 700. Further, standard wood 700 may exhibit gap 730 that may lead to instability in the wood.

Figure 8:
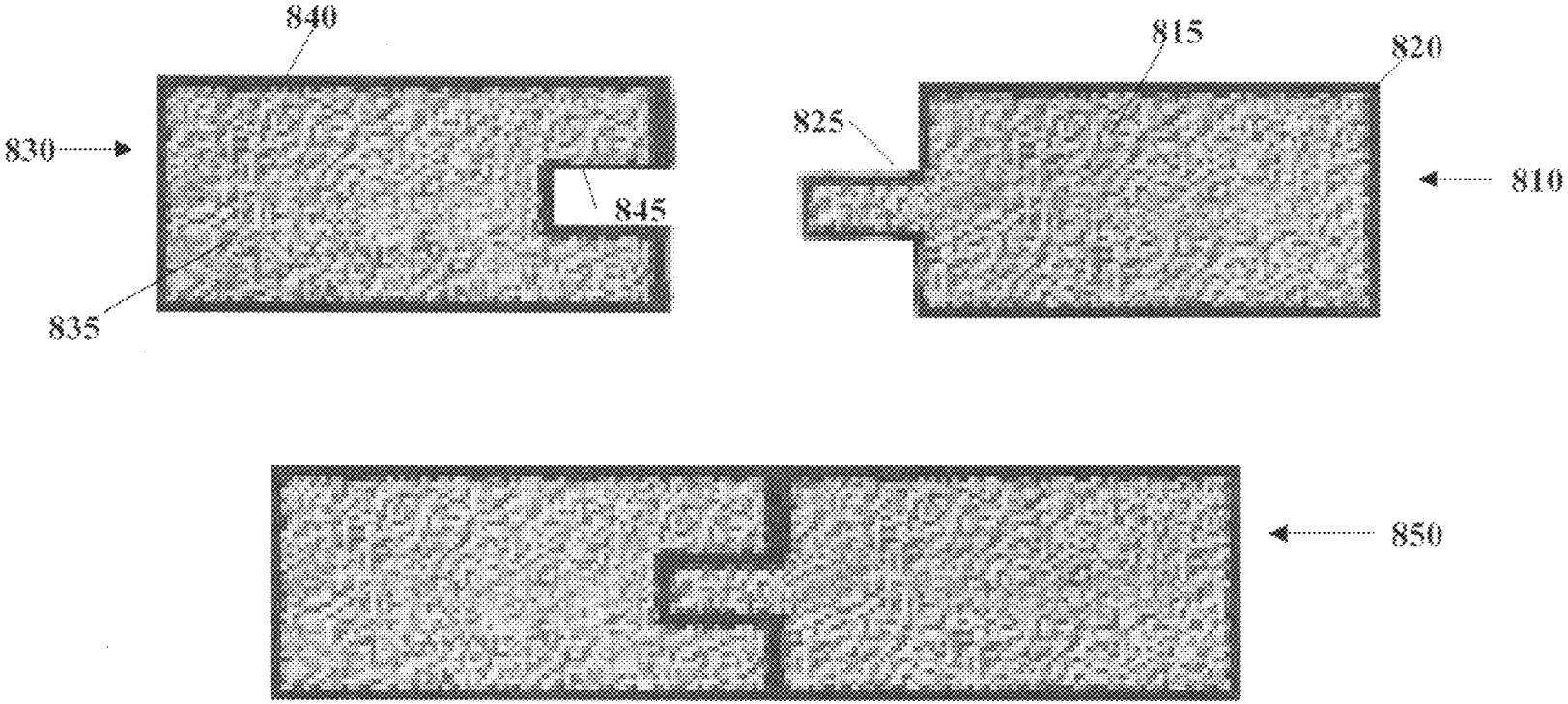
FIG. 8 illustratively displays a cross-sectional view of two dimensionally stable wood planks both including geometric variations which are used for combining two dimensionally stable planks in accordance with some embodiments of the disclosed subject matter.

Referring to FIG. 8, in some embodiments, combining two or more dimensionally stable wood planks creates minimal gap between geometric combinations (e.g., joints). That is, a first dimensionally stable wood 810 including wood 815, sealant layer 820, and geometric variation 825 may combine with a second dimensionally stable wood 830 including wood 835, sealant layer 840, and geometric variation 845 creating a combination wood 850. As shown, and unlike standard wood with a sealant layer only on one surface, dimensionally stable wood has a sealant layer on all surfaces and produces little or no gap when joined. In some embodiments, dimensionally stable wood has a sealant layer on four of its six surfaces.

In some embodiments, a sealant layer applied on dimensionally stable wood planks substantially improves tolerances for mating dimensionally stable wood planks. For example, dimensionally stable wood may have a tolerance of about 0.003 inches. In some instances, the sealant layer may fill in and/or smooth defects (e.g., pits, grooves, grain patterns, etc.) created when producing geometric variations (e.g., tongues and grooves) in the wood.

Figure 9:
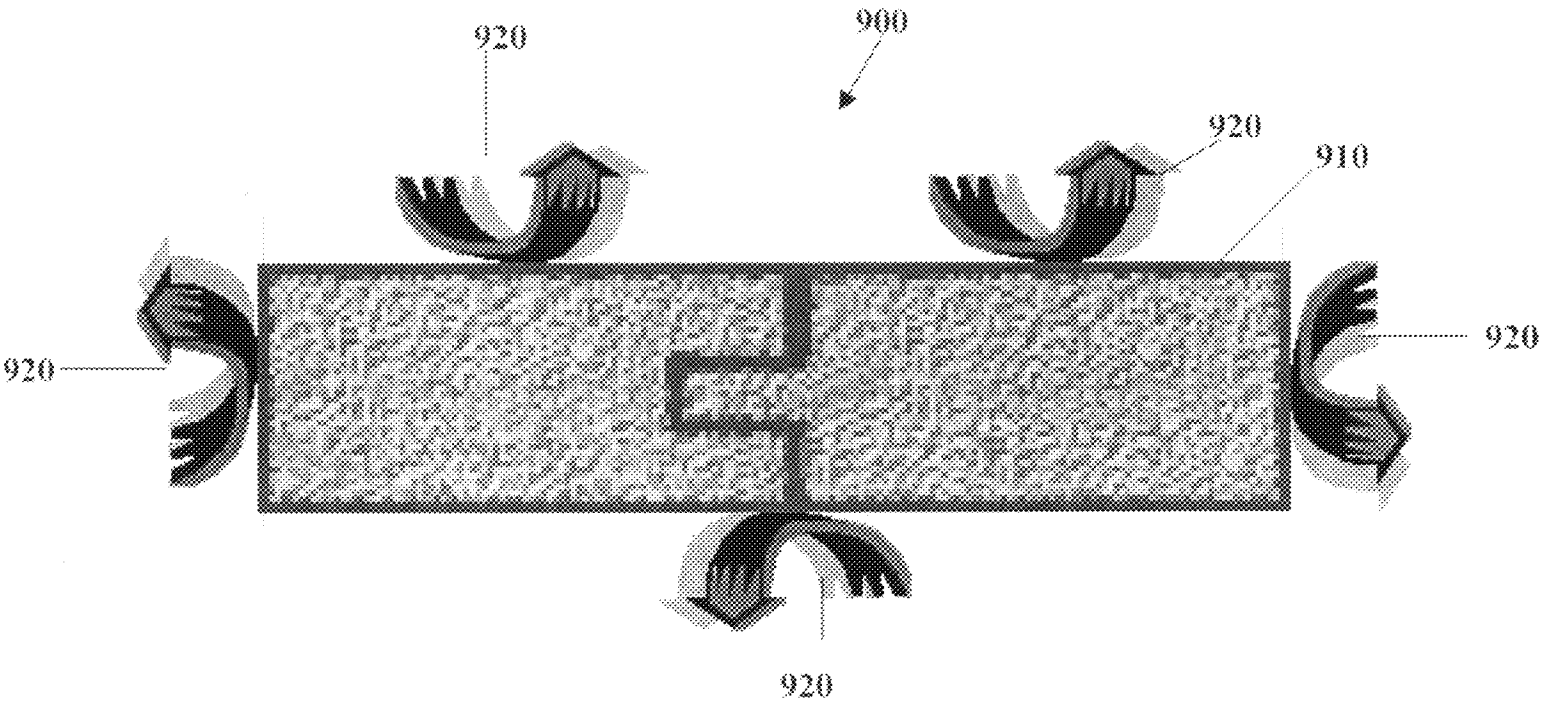
FIG. 9 illustratively displays a cross-sectional view of dimensionally stable wood planks joined together demonstrating the minimal gap created by the geometric variations and moisture at least partially prevented from penetrating in accordance with some embodiments of the disclosed subject matter.

Referring to FIG. 9, in some embodiments, combining two or more dimensionally stable wood planks produces a minimal gap between geometric variations (e.g., joints) and may at least partially prevent some, or all, moisture from penetrating into the wood. Combining two or more pieces of dimensionally stable wood may be used in building construction (e.g., flooring, paneling, etc.). For example, as indicated by arrows 920, in some embodiments, sealant layer 910 at least partially prevents moisture from entering into dimensionally stable wood 900. Further, in some embodiments, sealant layer 910 may remove some, or all, gapping between geometric variations. As shown, a sealant layer yields the benefit of enhanced moisture protection and tighter joints (i.e., no gaps).

It is to be understood that the invention is not limited in its application to the details of construction and to the arrangements of the components set forth in the preceding description or illustrated in the drawings. The invention is capable of other embodiments and of being practiced and carried out in various ways. Also, it is to be understood that the phraseology and terminology employed herein are for the purpose of description and should not be regarded as limiting.

Although the present invention has been described and illustrated in the foregoing illustrative embodiments, it is understood that the present disclosure has been made only by way of example, and that numerous changes in the details of implementation of the invention may be made without departing from the spirit and scope of the invention.

What is claimed is:

1. A dimensionally stable solid wood flooring strip for use at a job site, comprising:

a dimensionally stable solid wood flooring strip with at least six sides, four of which sides include a longitudinally-extending top side, a longitudinally-extending bottom side, and two longitudinally-extending side surfaces, the solid wood flooring strip having a moisture content that is substantially below ambient moisture; and a sealant layer adhered to each of at least said four sides of the solid wood flooring strip to maintain the moisture content at substantially below ambient moisture and for at least partially preventing liquids, gases, and objects from penetrating into the solid wood flooring strip;

wherein the sealant layer comprises at least one of UV-cured urethane, polyurethane, oil-modified urethane, moisture-cure urethane, acid cure urethane, water based urethane, acrylic-urethane, solvent cured urethane, aluminum oxide finishes, stain and wax, and ceramic sealer.

2. The flooring strip of claim 1, wherein the solid wood flooring strip has geometric variations on at least one side.

3. The flooring strip of claim 2, wherein the geometric variations comprise at least one woodworking joint comprising at least one of tongue and groove, butt, butterfly, dowel, dovetail, finger or box combing, lap (halving joint), cross-lap, halved joint, dovetail-lap, end-lap (corner halving joint), middle-lap (Tee halving joint), miter (mitre), mortise and tenon, rabbet (rebate), scarf (scarph), and splice joint.

4. The flooring strip of claim 2, wherein the sealant layer is adhered to the geometric variations.

5. The flooring strip of claim 2, wherein the geometric variations have adhered thereto the sealant layer for lessening at least one of liquids, gases, and objects from penetrating the wood flooring strip.

6. The flooring strip of claim 2, wherein the geometric variations have adhered thereto the sealant layer whereby a gap created by adjoining two or more dimensionally stable wood flooring strips can be lessened.

7. The flooring strip of claim 1, wherein the sealant layer on each of the at least four sides comprises substantially similar properties on each of the at least four sides.

8. The flooring strip of claim 1, wherein the sealant layer at least partially prevents moisture penetration.

9. The flooring strip of claim 1, further comprising the sealant layer being adhered to a remaining two sides of the wood flooring strip.

10. A method for producing dimensionally stable wood flooring strips, having at least six sides, from new wood planks for use at a job site, comprising:

forming geometric variations to the new wood plank to render varied solid wood flooring strips with at least six sides;

drying the solid wood flooring strip to a moisture content that is substantially below ambient moisture;

applying, to at least four sides, at least one sealant layer to the rendered varied solid wood flooring strips to maintain the moisture content at substantially below ambient moisture, four of which sides include a longitudinally-extending top side, a longitudinally-extending bottom side, and two longitudinally-extending side surfaces, wherein the at least one sealant layer is applied using at least one of vacuum coating and rollers; and curing the sealed solid wood planks with geometric variations after applying the at least one sealant layer.

11. The method of claim 10, wherein prior to forming the geometric variations the solid wood flooring strip is prepared by at least one of air-drying the wood plank, kiln drying the wood plank, and cleaning the wood plank.

12. The method of claim 10, wherein the applying step comprises vacuum coating a sealant layer onto the solid wood flooring strip.

13. The method of claim 10, wherein drying the solid wood flooring strip to a moisture content that is substantially below ambient moisture comprises, prior to forming the geometric variations, drying the solid wood flooring strip to a 6-8% moisture content.

14. The method of claim 10, wherein curing the wood plank comprises at least one of air-drying the wood, kiln drying the wood, cleaning the wood, and applying chemicals to the solid wood flooring strip.

15. The method of claim 10, further comprising sanding the dimensionally stable solid wood flooring strip on at least one side at the job site.

16. The method of claim 10, further comprising sanding the dimensionally stable solid wood flooring strip on at least one side, applying a sealant layer to the dimensionally stable wood plank, and shipping the dimensionally stable wood plank to the job site.

17. The method of claim 16, wherein the sealant layer comprises a finish.

18. The method of claim 10, further comprising using the dimensionally stable solid wood flooring strip in at least one of flooring and paneling in a building.

19. The method of claim 10, wherein said forming step comprises molding the geometric variations on at least one side of the dimensionally stable solid wood flooring strip.

20. The method of claim 10, wherein the molded geometric variations of the dimensionally stable solid wood flooring strip form a woodworking joint comprising at least one of tongue and groove, a butt, butterfly, dowel, dovetail, finger or box combing, lap (halving joint), cross-lap, halved joint, dovetail-lap, end-lap (corner halving joint), middle-lap (Tee halving joint), miter (mitre), mortise and tenon, rabbet (rebate), scarf (scarph), and splice joint.

21. The method of claim 10, further wherein the applying step comprises applying the sealant layer to the geometric variations first and then the remaining solid wood flooring strip.

22. A method for producing dimensionally stable solid wood flooring strip, having at least six sides, from new wood planks for use at a job site, comprising:

drying solid wood flooring strips to a moisture content that is substantially below ambient moisture;

applying at least one sealant layer to at least six sides of the solid wood flooring strips to maintain the moisture content at substantially below ambient moisture, the at least six sides comprising the top side, the bottom side, the two long edges and the two short edges; and curing the sealed solid wood flooring strips after applying the at least one sealant layer.

23. The method of claim 22, wherein the applying step comprises vacuum coating a sealant layer onto the at least four sides of the solid wood flooring strip.

24. The method of claim 22, wherein the applying step comprises using at least one roller for applying the sealant layer onto the solid wood flooring strip.

25. The method of claim 22, wherein drying solid wood flooring strips to a moisture content that is substantially below ambient moisture comprises, prior to the applying step, drying the solid wood flooring strips to a 6-8% moisture content.

26. The method of claim 22, wherein curing the solid wood flooring strip comprises at least one of air-drying the wood, kiln drying the wood, cleaning the wood, and applying chemicals to the wood.

27. The method of claim 22, further comprising sanding the dimensionally stable solid wood flooring strip on at least one side at the job site.

28. The method of claim 22, further comprising sanding the dimensionally stable solid wood flooring strip on at least one side, applying a sealant layer to the dimensionally stable solid wood flooring strip, and shipping the dimensionally stable solid wood flooring strip to the job site.

29. The method of claim 28, wherein the sealant layer comprises a finish.

30. The method of claim 22, further comprising using the dimensionally stable solid wood flooring strip in at least one of flooring and paneling in a building.

31. The dimensionally stable solid wood flooring strip of claim 2, wherein the wherein the geometric variations allow the solid wood flooring strip to be mated to another solid wood flooring strip with no gap.

32. The dimensionally stable solid wood flooring strip of claim 2, wherein the geometric variations allow the solid wood flooring strip to be mated along the longitudinal edges to another solid wood flooring strip with a tolerance of 0.003 inches.

33. The dimensionally stable solid wood flooring strip of claim 1, wherein the solid wood flooring strip has a moisture content of 6-8%.

* * * * *